US006089952A

United States Patent [19]

Dowd et al.

[11] Patent Number: 6,089,952

[45] Date of Patent: Jul. 18, 2000

[54] FOUR WHEEL DRIVE TOY LOCOMOTIVE

[75] Inventors: Paul Dowd, Bronxville; Will Isaksson, New York, both of N.Y.; Donald Toht, Wheaton; Jeff Katz, Chicago, both of Ill.

[73] Assignee: Learning Curve International, Inc., Chicago, Ill.

[21] Appl. No.: 09/014,499

[22] Filed: Jan. 28, 1998

[51] Int. Cl.[7] ..... A63H 29/24; A63H 19/02

[52] U.S. Cl. ..... 446/463; 446/467

[58] Field of Search ..... 446/431, 443, 446/444, 445, 447, 457, 462, 465, 467, 463

[56] References Cited

U.S. PATENT DOCUMENTS

| | | | |
|---|---|---|---|
| 3,812,933 | 5/1974 | Darda | 446/462 X |
| 4,152,866 | 5/1979 | Suda | 446/463 |
| 4,283,879 | 8/1981 | Tsui | 446/463 |
| 4,306,375 | 12/1981 | Goldfarb et al. . | |
| 4,511,343 | 4/1985 | Goldfarb et al. | 446/463 |
| 4,540,380 | 9/1985 | Kennedy et al. | 446/463 |
| 4,565,538 | 1/1986 | Kennedy et al. . | |
| 4,573,943 | 3/1986 | Kennedy et al. | 446/463 |
| 4,734,077 | 3/1988 | Taylor et al. . | |
| 4,813,906 | 3/1989 | Matsuyama et al. . | |
| 4,889,516 | 12/1989 | Auer et al. . | |
| 4,976,650 | 12/1990 | Watanabe . | |
| 5,135,428 | 8/1992 | Shibayama et al. | 446/463 |
| 5,334,076 | 8/1994 | Shinozuka . | |
| 5,427,561 | 6/1995 | Eichhorn et al. | 446/463 |
| 5,487,692 | 1/1996 | Mowrer et al. . | |
| 5,549,501 | 8/1996 | Jow . | |
| 5,586,924 | 12/1996 | Huang . | |

FOREIGN PATENT DOCUMENTS

| | | | |
|---|---|---|---|
| 233680 | 5/1961 | Australia | 446/462 |
| 2112656 | 7/1983 | United Kingdom | 446/462 |
| 2128887 | 5/1984 | United Kingdom | 446/462 |
| 2131309 | 6/1984 | United Kingdom | 446/462 |

OTHER PUBLICATIONS

Speed–Changing Mechanisms (pp. 322–325 from testbook).

*Primary Examiner*—D Neal Muir
*Attorney, Agent, or Firm*—Wallenstein & Wagner, Ltd.

[57] ABSTRACT

A battery operated miniature toy locomotive for use in a toy railway system is claimed. The toy railway system comprises a toy railway track configuration made up of a plurality of wooden toy railway track segments. Each wooden track segment has a pair of uniformly spaced depressions extending from a first connecting end to a second connecting end of each wooden track segment. The toy locomotive has a first pair of wheels positioned at a proximal end of the toy locomotive and a second pair of wheels positioned at a distal end of the toy locomotive. The first and second pairs of wheels are adapted for placement within the depressions formed on each wooden track segment. The toy locomotive further comprises a locomotive housing which has an interior surface and an exterior surface, and a motor for providing energy to the first pair of wheels and the second pair of wheels. The motor is positioned within the housing and operatively connected with the first pair of wheels and the second pair of wheels wherein both pairs of wheels are simultaneously powered by the motor.

19 Claims, 3 Drawing Sheets

FOUR WHEEL DRIVE TOY LOCOMOTIVE

TECHNICAL FIELD

The present invention relates generally to toy vehicles and, more particularly, to a four wheel drive toy locomotive for inclusion in a toy railway system.

BACKGROUND

In the toy vehicle industry, small toy trains are often run on wooden tracks. These railway systems are designed to grow with the child. In other words, railway configurations can range from very simple ovals to complex systems incorporating bridges, buildings, tunnels, and towns. Many other accessories are available as well such as: toy figurines, bushes, shrubs, and trees to lend the system a realistic effect; playmats, playboards, and play tables on which to build a railway system; carry bags and boxes in which to store the railway system when not in use; and, storybooks, iron-ons, decals, and coloring books to further stimulate the child's imagination.

The railway configurations are built from individual track sections. The track sections range in size and shape. There are countless possibilities for individual track sections: some are straight; some feature switching mechanisms; some are curved; and, some are ascending for connection to another track positioned at a higher level.

One of the most important aspects of these railway systems is that the track sections be interchangeable. Accordingly, most track sections include male and/or female connectors at opposing ends. This allows the track sections to be connected end to end in a variety of configurations. Adding to the interchangeability of the track sections is the fact that these track sections are usually reversible having rail depressions on both sides.

Until recently, the toy locomotives employed to push or pull other toy railway vehicles around the tracks were powered almost exclusively by external forces. The external forces were generally supplied by the person playing with the toy locomotive. Recently, battery powered toy locomotives were introduced so that the toy locomotives were self-powered and, therefore, capable of traversing along the toy railway configuration without the aid of external forces.

These attempts at providing a battery powered toy locomotive have been met with mixed results. Individually, the toy locomotive traversed the railway configuration adequately. However, when encumbered with a load, the toy locomotives performed less satisfactorily. For example, the toy locomotives were unable to pull other toy railway cars.

In addition, these early battery powered toy locomotives have been two-wheel, rear-wheel drive vehicles. This configuration does not provide the power necessary to reliably climb ascending toy track segments nor does it provide the power necessary to push and pull other toy railway cars.

Furthermore, these toy locomotives do not have a fully disengageable clutch. Therefore, when the toy locomotive is not powered, these toy locomotives do not freewheel and are difficult to advance without some effort by the user.

Finally, the early attempts at providing a battery operated toy locomotive utilized AAA sized batteries. Coupled with the inefficiency of the motors employed, the useful life of the battery was insufficient.

Therefore, there is a need for an improved battery operated toy locomotive for use with the toy railway systems described herein.

SUMMARY OF THE INVENTION

The present invention provides a novel self-powered toy vehicle for use in a railway system. The toy locomotive is generally attachable to a second toy vehicle and capable of traversing along a toy railway configuration made up of a plurality of wooden toy railway segments. Each of the wooden track segments has a pair of uniformly spaced depressions extending the length of the wooden track segment.

The toy locomotive is a miniature, battery operated toy vehicle. It has a first pair of wheels positioned at a proximal end of the locomotive and a second pair of wheels positioned at a distal end of the locomotive. The wheels are adapted to fit within the depressions formed on the wooden track segments. The toy locomotive further comprises a housing and a motor. The motor fits within the housing and is operatively connected to the first and second pairs of wheels. The wheels are simultaneously powered to provide a four wheel drive vehicle.

Other features and advantages of the invention will be apparent from the following specification taken in conjunction with the following drawing.

DETAILED DESCRIPTION

Figure 1:
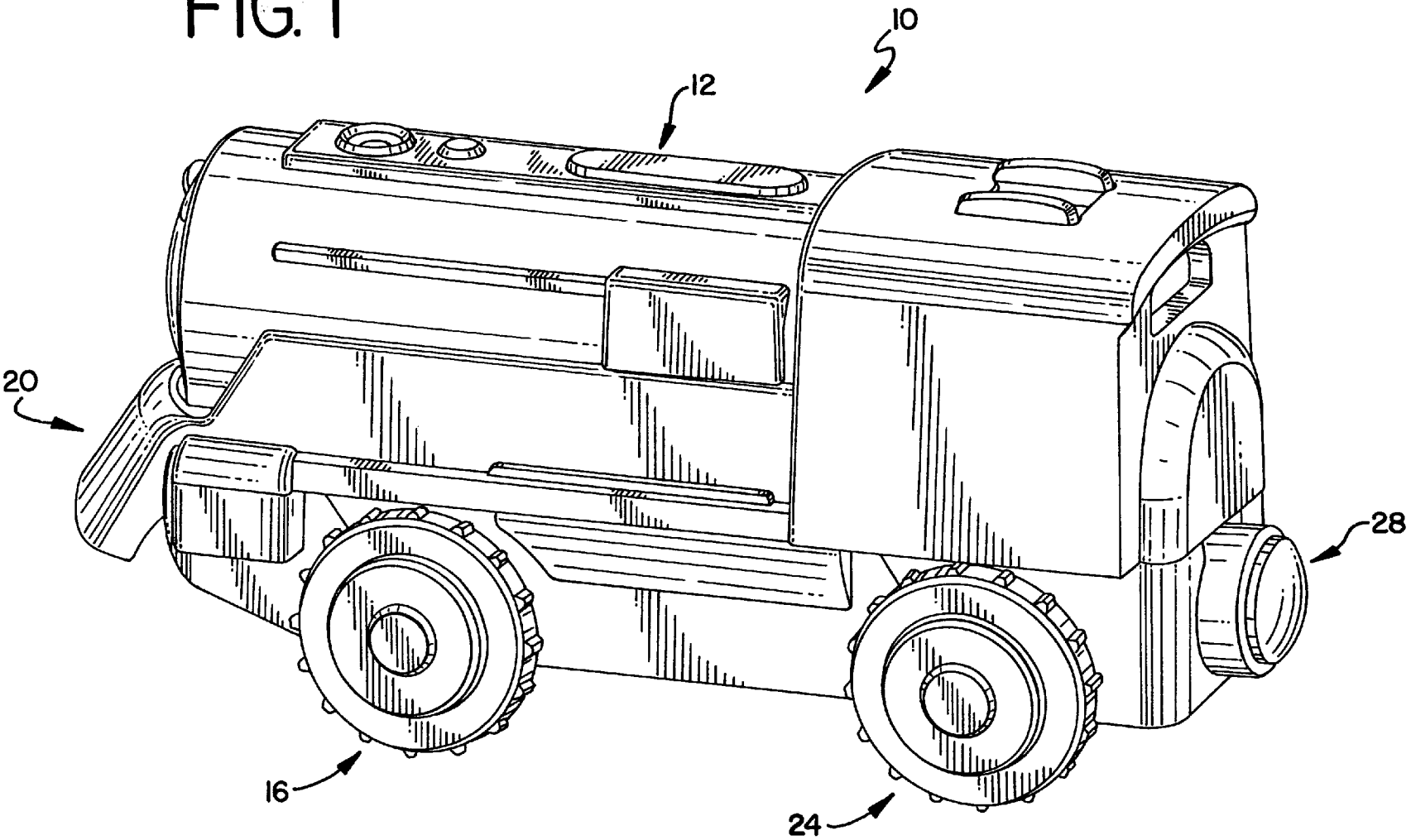
FIG. 1 is a perspective view of a battery operated miniature toy locomotive.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 is a perspective view of a self-powered toy vehicle 10 of the present invention. The self-powered toy vehicle 10 of FIG. 1 comprises a miniature locomotive body 12, a first wheel system 16 positioned at a proximal end 20 of the toy vehicle 10, and a second wheel system 24 positioned at a distal end 28 of the toy vehicle 10.

Figure 2:
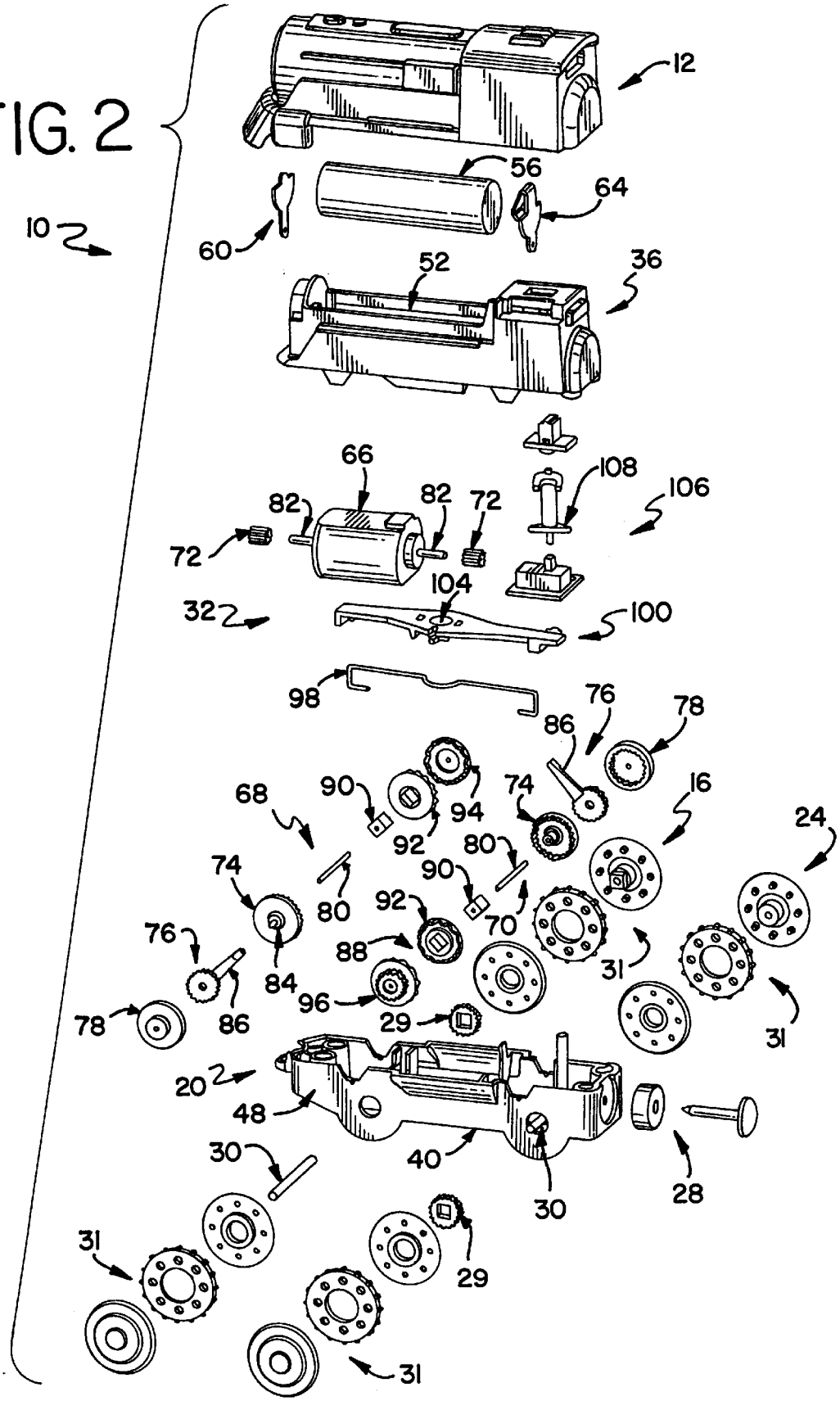
FIG. 2 is an exploded perspective view of a battery operated miniature toy locomotive.

FIG. 2 is an exploded perspective view of the self-powered toy vehicle 10 of the present invention. FIG. 2 shows that the first and second wheel systems 16, 24 are substantially identical. Accordingly, each wheel system 16, 24 comprises a drive gear 29 and an axle 30 which connects opposing tire assemblies 31. The drive gear 29 has a square opening for receiving an elongate, square-ended boss located on the tire assembly 31. This structure leads to an easy assembly because the axle 30 easily passes through the larger square opening in the drive gear 29 rather than force fit through the drive gear 29. Furthermore, this structure provides a more reliable wheel system because the drive gear 29 directly drives the tire assembly 31 rather than relying on a high tolerance press fit with the axle 30. It also provides shock protection to the axle 30 because the elongate, square-ended boss transmits the shocks experienced by the tire assembly 31 directly to a housing 32 rather than the axle 30.

As shown in FIG. 2, the locomotive body 12 provides a cover for the housing 32. The cover can be fashioned to resemble any toy vehicle, but in the preferred embodiment of this invention, the cover resembles a toy locomotive body. The housing 32 comprises an upper portion 36, a lower portion 40, an interior surface 44, and an exterior surface 48. The upper portion 32 includes a battery receiving portion 52 adapted for maintaining a AA sized battery 56. A positive terminal 60 is positioned at one end of the battery receiving portion 52 and a negative terminal 64 is positioned at an opposing end.

The lower portion 40 of the housing 32 provides the chassis for the toy vehicle 10. Accordingly, the lower portion 40 provides a space for a motor 66 and the gearing that drives the first and second wheel systems 16, 24. In the preferred embodiment, a Mabuchi FA-130RA-2270 double drive shaft motor is utilized.

The gearing that drives the first and second wheel systems 16, 24 comprises first and second wobble gear assemblies 68, 70. These wobble gear assemblies 68, 70 provide increased efficiency over the gearing assemblies currently available, and the life of the batteries used to power the toy vehicles is prolonged as high as three times. The first and second wobble gear assemblies 68, 70 are substantially identical. The first wobble gear assembly 68 drives the first wheel system 16, and the second wobble gear assembly 70 drives the second wheel system 24.

The first and second wobble gear assemblies 68, 70 each comprise a pinion 72, a crown gear 74, a spur gear 76, an internal gear 78, and a rod 80. The pinion 72 is joined to a drive shaft 82 which extends from the motor 66. As the drive shaft 82 turns, the pinion 72 turns. The pinion's 72 teeth mate with the crown gear's 74 teeth to drive the crown gear 74. The crown gear 74 spins freely about the rod 80 which defines an axis of rotation. The teeth of the crown gear 74 are generally parallel with the axis of rotation. The crown gear 74 is backed by an eccentric spur gear driver 84. The eccentric spur gear driver 84 is used to drive the spur gear 76. The eccentric spur gear driver 84 is positioned on the rear face of the crown gear 74 and is slightly off-center. In the preferred embodiment, the eccentric spur gear driver 84 is positioned approximately 0.012 ins. from the axis of rotation.

The spur gear 76 has an appendage 86 which extends from the body of the spur gear 76. The appendage contacts a portion of the housing 32 to prevent the spur gear 76 from rotating about the axis of rotation. Rather than rotating about the axis of rotation, the spur gear 76 has an orbital movement. The spur gear 76 orbits about the axis of rotation. The teeth of the spur gear 76 engage the teeth of the internal gear 78 to drive the internal gear 78. In the preferred embodiment, the spur gear 76 has nineteen teeth and the internal gear 78 has twenty teeth. Therefore, the spur gear 76 rotates the internal gear 78 through the equivalent of one tooth space for each orbit. Thus, the crown gear 74 will make twenty revolutions to one revolution of the internal gear 78.

The rod 80 is attached to the internal gear 78 so that one revolution of the internal gear 78 produces one revolution of the rod 80. The rod 80 extends through the spur gear 76 and the crown gear 74 so that the spur gear 76 and the crown gear 74 freewheel about the rod 80. The rod 80 is attached to a clutch assembly 88 at an end opposing the end connected to the internal gear 78.

In the preferred embodiment, there are first and second clutch assemblies 88. The clutch assemblies 88 are substantially identical. Accordingly, each clutch assembly 88 comprises a block key 90, a first clutch 92 plate, a second clutch plate 94, a wheel gear 96, and a clutch spring 98. In the preferred embodiment shown in the drawings, a single clutch spring 98 is provided. The rod 80 is attached to the block key 90 which is slidably fit into the first clutch plate 92. The first clutch plate 92 engages the second plate 94 and transfers movement by the rod 80 to the second clutch plate 94 which freewheels about the rod 80. The teeth on the first and second clutch plates 92, 94 are rounded so that they are not tightly interlocked. In other words, when a force external to the toy vehicle 10 is greater than the force that holds the first and second clutch plates 92, 94 in contact, the first clutch plate 92 partially disengages the second clutch plate 94 by sliding back along block key 90, and the clutch plates 92, 94 will not be locked together because the teeth are not tightly interlocked and, therefore able to turn against each other when this occurs. These clutch assemblies 88 prevent damage from occurring to the various gears and the motor 66 from overheating.

The wheel gear 96 is connected to the second clutch plate 94. Each wheel gear 96 drives the corresponding wheel assembly 16, 24 by engaging the wheel assemblies' drive gears 29.

The clutch spring 98 engages the first clutch plate 92 and provides the engaging force between the first and second clutch plates 92, 94. In the preferred embodiment, the clutch spring 98 is a thin, elongate member produced from a material which is capable of undergoing a degree of elastic deformation.

Figure 3:
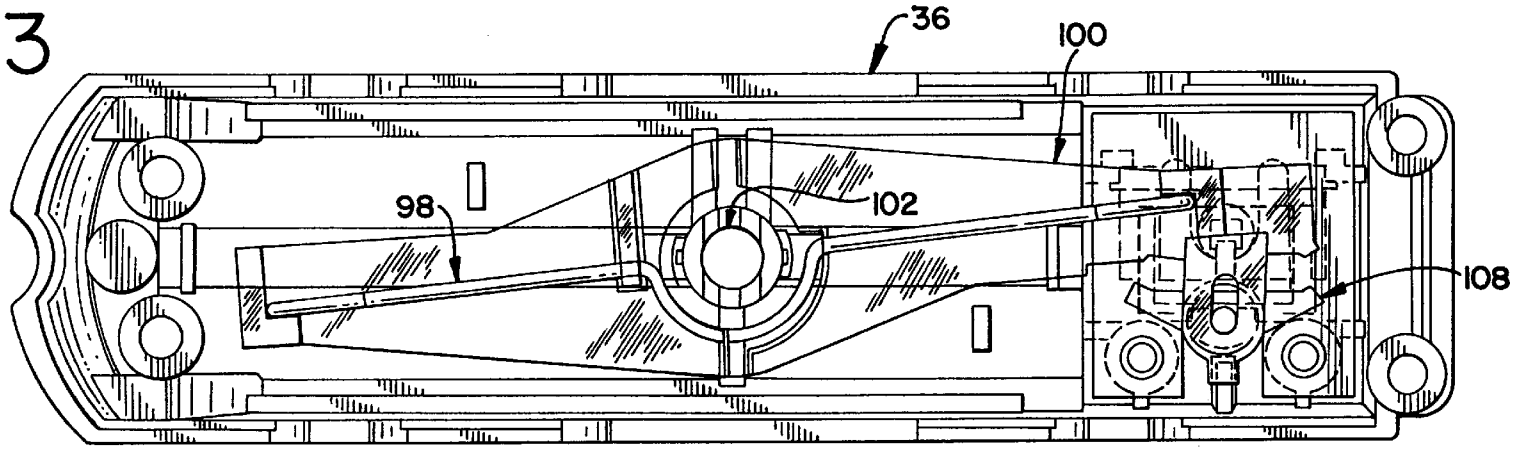
FIG. 3 is a cut away bottom view of the upper portion of a housing of a battery operated miniature toy locomotive.
Figure 4:
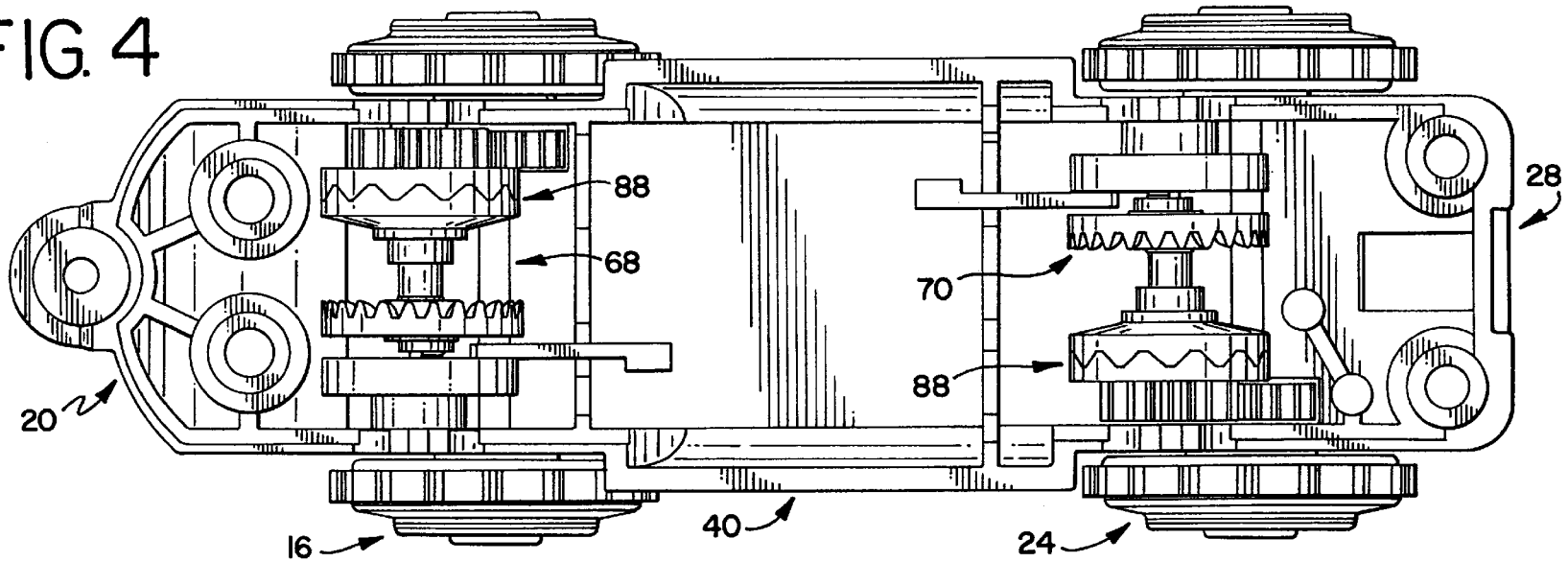
FIG. 4 is a cut away top view of the lower portion of a housing of a battery operated miniature toy locomotive.

The clutch spring 98 is attached to a pivotable lever 100 which supports the clutch spring 98 within the housing 32. The pivotable lever 100 is attached to the upper portion 36 of the housing 32 by a round boss 102 (see FIG. 3) which frictionally engages an aperture 104 located approximately in the center of the pivotable lever 100. The pivotable lever 100 is capable of pivoting about the round boss/aperture connection. This allows the clutch spring 98 to be selectively positioned so that the engaging force, which keeps the first and second clutch plates 92, 94 in operative communication, is either applied or not applied.

A transmission switch 106 provides the pivoting force which determines whether the engaging force is selectively applied or not applied. The transmission switch 106 is a three position switch. Accordingly, the transmission switch 106 can be selectively positioned in a neutral or off position in which the clutch assemblies 88 are disengaged and the motor 66 is not powered, a reverse position, or a forward position. In the reverse and forward positions, the motor 66 is powered and the clutch assemblies 88 are engaged. As the names suggests, the reverse position causes the toy vehicle 10 to move backward, and the forward position causes the toy vehicle 10 to move forward. The transmission switch 106 includes a small arm 108 that contacts the pivotable lever 100 when the transmission switch 106 is in the forward and reverse positions. This arm 108 forces the pivotable lever 100 to move the clutch spring 98 into contact with the first clutch plate 92, and thus provide the engaging force to the clutch assembly 88.

While specific embodiments have been illustrated and described, numerous modifications are possible without departing from the spirit of the invention, and the scope of protection is only limited by the scope of the accompanying claims.

What is claimed is:

1. A self-powered toy vehicle which is attachable to a second toy vehicle and capable of transferring movement to the second toy vehicle, the self-powered toy vehicle comprising:

a housing having an interior surface and an exterior surface;

a first wheel system and a second wheel system each having a pair of wheels, at least a portion of each wheel extending beyond the exterior surface of the housing;

a motor engaging a gear assembly for providing energy to the first wheel system; and a selectively activated clutch assembly interconnected to the gear assembly for disengaging the gear assembly from the first wheel system in response to a damaging external force provided to the self-powered toy vehicle wherein the first wheel system can be separately temporarily released from the gear assembly in response to the damaging external force; and a transmission switch interconnected to the selectively activated clutch assembly providing a spring force to engage and disengage the gear assembly.

2. The self-powered toy vehicle of claim 1 wherein the selectively activated clutch assembly comprises:

a first clutch plate and a second clutch plate in mirror image relationship, the first and second clutch plates being cooperatively engageable;

a block key in communication with the first clutch plate for transferring energy from the motor to the first clutch plate;

a wheel gear in communication with the second gear for transferring energy to the first wheel system; and a clutch spring interconnected to the transmission switch for providing an engaging force by which the first and second clutch plates are engaged.

3. The self-powered toy vehicle of claim 2 wherein the engaging force can be offset by an external force applied to the first wheel system wherein the first and second clutch plates partially disengage allowing the first and second clutch plates to slidably rotate against each other wherein the external force is not transferred to the gear assembly.

4. The self-powered toy vehicle of claim 3 wherein the transmission switch can be selectively positioned between a forward position, a reverse position, and a neutral position wherein the selectively activated clutch assembly is engaged in the forward and reverse positions and disengaged in the neutral position.

5. The self-powered toy vehicle of claim 4 wherein the selectively activated clutch assembly further comprises a pivotable lever for supporting the clutch spring, the pivotable lever being engageable with the transmission switch wberein selectively positioning the transmission switch in the forward and reverse positions causes the pivotable lever to move the clutch spring into a position to provide the engaging force to the first clutch plate.

6. The self-powered toy vehicle of claim 2 wherein the wherein assembly comprises a wobble gear assembly between the motor and the selectively activated clutch assembly, the wobble gear assembly engaging the motor at a first end and the clutch assembly at a second end for transferring energy from the motor to the first wheel system.

7. The self-powered toy vehicle of claim 6 wherein the wobble gear assembly comprises:

a pinion connected to a drive shaft which extends from the motor;

a crown gear for engaging the pinion on one side and having an eccentric spur gear driver on an opposing side;

a spur gear in communication with the eccentric spur gear driver wherein a rotational movement provided to the crown gear produces an orbital movement in the spur gear;

an internal gear powered by the spur gear wherein the orbital movement of the spur gear produces a rotational movement in the internal gear; and a rod connected at a first end to the internal gear and having a second end for transferring energy to the first wheel system wherein the rotational movement by the internal gear is transferred along the rod to the first wheel system.

8. A toy railway system comprising a miniature battery operated toy locomotive attachable to a second toy railway vehicle for traversing along a toy railway track configuration made up of a plurality of wooden toy railway track segments, each wooden track segment having a pair of uniformly spaced depressions extending from a first connecting end to a second connecting end of each wooden track segment, the toy locomotive having a first pair of wheels positioned at a proximal end of the toy locomotive and a second pair of wheels positioned at a distal end of the toy locomotive, the first and second pairs of wheels adapted for placement within the depressions formed on each wooden track segment, the toy locomotive comprising:

a toy locomotive housing having an interior surface and an exterior surface;

a motor for providing energy to the first pair of wheels and the second pair of wheels, the motor positioned within the housing and operatively connected to a first gear assembly which is operatively connected to the first pair of wheels and a second gear assembly which is operatively connected to the second pair of wheels wherein both pairs of wheels are simultaneously powered by the motor;

a first selectively activated clutch assembly and a second selectively activated clutch assembly interconnected to the first and second gear assemblies respectively for separately disengaging the first and second gear assemblies from the first and second pairs of wheels in response to a damaging external force provided to the toy locomotive wherein the first and second pairs of wheels can be separately temporarily released from the first and second gear assemblies respectively in response to the damaging external force; and a transmission switch interconnected to the first and second selectively activated clutch assemblies providing a spring force to engage and disengage the first and second gear assemblies.

9. A self-powered toy vehicle attachable to a second toy vehicle and capable of transferring movement to the second toy vehicle, the self-powered toy vehicle comprising:

a housing having an interior surface and an exterior surface;

a first wheel system having a pair of wheels, at least a portion of each wheel extending beyond the exterior surface of the housing;

a motor for providing energy to the first wheel system positioned within the housing; and a first wobble gear assembly engaging the motor at a first end and the first wheel system at a second end for transferring energy from the motor to the first wheel system wherein the wobble gear assembly comprises:

a pinion connected to a drive shaft which extends from the motor;

a crown gear for engaging the pinion on one side and having an eccentric spur gear driver on an opposing side;

a spur gear in communication with the eccentric spur gear driver wherein a rotational movement provided to the crow gear produces an orbital movement in the spur gear;

an internal gear powered by the spur gear wherein the orbital movement of the spur gear produces a rotational movement in the internal gear; and a rod connected at a first end to the internal gear and having a second end for transferring energy to the first wheel system wherein the rotational movement by the internal gear is transferred along the rod to the first wheel system.

10. The self-powered toy vehicle of claim 9 wherein the crown gear has an axis of rotation and the eccentric spur gear driver is located at a position which is off-center from the axis of rotation.

11. The self-powered toy vehicle of claim 9 wherein the crown gear freewheels about the rod.

12. The self-powered toy vehicle of claim 9 wherein the spur gear freewheels about the rod.

13. The self-powered toy vehicle of claim 9 wherein the spur gear comprises an appendage which engages the housing to prevent the spur gear from having a rotational movement whereby the spur gear exhibits the orbital movement.

14. The self-powered toy vehicle of claim 9 including a clutch assembly connected to the second end of the rod and positioned between the wobble gear assembly and the first wheel system for disengaging the first wobble gear assembly from the first wheel system wherein each wheel is freewheeling when the clutch assembly is disengaged.

15. The self-powered toy vehicle of claim 14 wherein the clutch assembly comprises:

a first clutch plate and a second clutch plate in mirror image relationship, the first and second clutch plates being cooperatively engageable;

a block key in communication with the first clutch plate for transferring energy from the motor to the first clutch plate;

a wheel gear in communication with the second clutch plate for transferring energy to the first wheel system; and a clutch spring for providing an engaging force by which the first and second clutch plates are engaged.

16. The self-powered toy vehicle of claim 15 further comprising a second wheel system having a second pair of wheels, at least a portion of each wheel extending beyond the exterior surface of the housing, and a second wobble gear assembly substantially similar to the first wobble gear assembly and engaging the motor at a first end and the second wheel system at a second end for transferring energy from the motor to the second wheel system.

17. The self-powered toy vehicle of claim 9 wherein the motor can be operated in either a forward mode or a reverse mode.

18. The self-powered toy vehicle of claim 9 wherein the first wheel system comprises a tire assembly, an axle, and a drive gear the drive gear having a square aperture and the tire assembly having an elongate, square-ended boss for insertion into the square aperture.

19. A self-powered vehicle which is attachable to a second toy vehicle and capable of transferring movement to the second toy vehicle, the self-powered toy vehicle comprising:

a housing having an interior surface and an exterior surface;

a first wheel system having a pair of wheels, at least a portion of each wheel extending beyond the exterior surface of the housing;

a motor for providing energy to the first wheel system positioned within the housing; and a pinion connected to a drive shaft which extends from the motor;

a crown gear for engaging the pinion on one side and having an eccentric spur gear driver on an opposing side;

a spur gear in communication with the eccentric spur gear driver wherein a rotational movement provided to the crown gear produces an orbital movement in the spur gear;

an internal gear powered by the spur gear wherein the orbital movement of the spur gear produces a rotational movement in the internal gear; and a rod connected at a first end to the internal gear and having a second end for transferring energy to the first wheel system wherein the rotational movement by the internal gear is transferred along the rod to the first wheel system.

* * * * *